US009889465B2

(12) United States Patent
Ettlin

(10) Patent No.: US 9,889,465 B2
(45) Date of Patent: Feb. 13, 2018

(54) DISPENSING APPARATUS

(71) Applicant: Sulzer Mixpac AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 261 days.

(21) Appl. No.: 14/649,275

(22) PCT Filed: Nov. 27, 2013

(86) PCT No.: PCT/EP2013/074849
§ 371 (c)(1),
(2) Date: Jun. 3, 2015

(87) PCT Pub. No.: WO2014/086635
PCT Pub. Date: Jun. 12, 2014

(65) Prior Publication Data

US 2016/0016194 A1 Jan. 21, 2016

(30) Foreign Application Priority Data

Dec. 3, 2012 (EP) ..... 12195273

(51) Int. Cl.
*B05C 17/01* (2006.01)
*B05C 17/005* (2006.01)

(52) U.S. Cl.
CPC .... *B05C 17/00553* (2013.01); *B05C 17/0136* (2013.01)

(58) Field of Classification Search
CPC ..... B05C 17/00553; B05C 17/0136; B05C 17/01; B65D 81/325; A61C 5/064; A61M 5/14546; A61M 5/19; A61M 5/20
USPC ..... 222/135, 137, 389, 386, 386.5
See application file for complete search history.

(56) References Cited

U.S. PATENT DOCUMENTS 3,572,336 A 3/1971 Hershberg
4,583,934 A * 4/1986 Hata ..... B05C 17/0103 222/327
5,975,367 A * 11/1999 Coelho ..... A61B 17/00491 222/137
6,223,936 B1 5/2001 Jeanbourquin
6,464,663 B1 10/2002 Zinger
7,857,791 B2 12/2010 Jacobs et al.
(Continued)

FOREIGN PATENT DOCUMENTS

CN 1835810 A 9/2006
CN 1933864 A 3/2007
(Continued)

*Primary Examiner* — Paul R Durand
*Assistant Examiner* — Robert Nichols, II
(74) *Attorney, Agent, or Firm* — Global IP Counselors, LLP

(57) ABSTRACT

A discharging device simultaneously delivers at least two flowable components of a multi-component compound from different storage volumes. The discharging device includes at least two pistons which are movable along an extension direction thereof to deliver the components from the at least two storage volumes, and an advancing unit for moving the pistons along the extension direction thereof. The advancing unit has at least one energy storage element, which is provided for supplying a force for moving the pistons and at least one release element, which is provided for releasing the movement of the pistons by the at least one storage element.

9 Claims, 2 Drawing Sheets

(56) References Cited

U.S. PATENT DOCUMENTS

| | | | | |
|---|---|---|---|---|
| 7,938,296 | B2 | 5/2011 | Keller | |
| 8,038,651 | B2 * | 10/2011 | Keller | A61M 5/1454 604/131 |
| 2007/0166660 | A1 | 7/2007 | Peuker et al. | |
| 2008/0314929 | A1 | 12/2008 | Keller | |

FOREIGN PATENT DOCUMENTS

| | | | |
|---|---|---|---|
| CN | 101203327 | A | 6/2008 |
| EP | 1986751 | B1 | 4/2011 |
| WO | 98/40115 | A1 | 9/1998 |
| WO | 98/40167 | A1 | 9/1998 |

* cited by examiner

DISPENSING APPARATUS

CROSS-REFERENCE TO RELATED APPLICATIONS

This application is a U.S. National stage application of International Application No. PCT/EP2013/074849, filed Nov. 27, 2013, which claims priority to EP Patent Application 12195273.3, filed Dec. 3, 2012, the contents of each of which are hereby incorporated herein by reference.

BACKGROUND

Field of the Invention

The invention relates to a dispensing apparatus for the simultaneous dispensing of at least two flowable components of a multicomponent mass from different storage volumes.

Background Information

From EP 1 968 751 B1 a dispensing apparatus is already known for the simultaneous dispensing of at least two flowable components of a multicomponent mass from different storage volumes having at least two pistons which can be moved along their direction of extent for the dispensing of the components from the at least two storage volumes, and having a feed unit for moving the pistons along the direction of extent.

SUMMARY

The present invention is, in particular based on the object of supplying a dispensing apparatus for a multicomponent mass which enables a simple operation. It is satisfied by a dispensing apparatus in accordance with a dispensing apparatus for the simultaneous dispensing of at least two flowable components of a multicomponent mass from different storage volumes.

The invention is based on a dispensing apparatus for the simultaneous dispensing of at least two flowable components of a multicomponent mass from different storage volumes, having at least two pistons, which can be moved along their direction of extent for the dispensing of the components from the at least two storage volumes and having a feed unit for moving the pistons along their direction of extent.

It is suggested that the feed unit has at least one energy storage element which is provided to supply a force for the movement of the piston and having at least one release element which is provided to release the movement of the piston by the at least one energy storage element. In that the pistons are moved by one or more energy storage elements a force does not have to be applied by an operator for moving the piston. Thereby a dispensing apparatus for a multicomponent mass can be provided which enables a simple operation. A multicomponent mass should, in particular be understood as a flowable mass composed of at least two components, wherein at least one of the components is an activator by which a chemical reaction is initiated after a mixing of the components through which chemical or physical properties of the multicomponent mass are changed. The multicomponent mass can, however, for example, also be a cream for the application on the skin, to which additional components, such as e.g. vitamins are admixed only shortly before the dispensing of a basic cream. A "component of the multicomponent mass" should in this connection, in particular be understood as a flowable material which can be stored over a period of time in the unmixed state with other components, which period of time is longer than a period of time during which the chemical reaction takes place after the mixing of the components. Preferably, the components separated from one another can be stored for a period of time of weeks, months or years, while the multicomponent mass takes on its final properties after the mixing of the components within a period of time of seconds, minutes or also hours. An "energy storage element" should, in particular be understood to be a mechanical component which is provided to store an energy and to provide this in the form of a force acting on the piston. The at least one energy storage element is preferably configured as a mechanical spring. Generally, however, also a different design, for example, by means of a pressurized container in which a gas pressure is transferred into the force for the movement of the piston is plausible. A "release element" should, in particular be understood as a component which is provided for an actuation through a user and which directly or indirectly releases the piston for a movement. "Directly released" in this connection should, in particular be understood such that the release element unlocks the piston from a movement point of view while the at least one energy storage element constantly exerts a force on the piston. An "indirect release" should, in particular be understood, such that the release element is provided to release the movement of the piston in that it switches free or activates the at least one energy storage element for a force release, for example, when the at least one energy storage element is configured by means of a pressurized container. "Provided" should, in particular be understood as specifically designed and/or equipped.

It is further suggested that the feed unit has a track element (latching track element) and at least one latching element which are provided to latch the at least two pistons against the force of the energy storage element. Thereby, the force of the at least one energy storage element, which acts on the piston, can be supported particularly simply at the housing. Moreover, a simple and compact design of the feed unit is possible. A "track element" should, in particular be understood as a component which is provided for an, in particular form-fitted connection to a corresponding latching element, wherein also a force-fitting connection is possible. A "latching element" should, in particular be understood as a component for the interaction with the track element. "Latching" should, in particular be understood as a purely form-fitted connection which is provided for the support of the force exerted by the at least one energy storage element and which can be released by a relative movement between the latching element and the track element in a direction which is orientated at least substantially perpendicular to a direction along which the force is lying. "At least substantially perpendicular" should in this connection, in particular be understood such that the direction in which the force acts encloses an angle of at least 80 degrees with the direction along which the relative movement takes place.

The dispensing apparatus is, for example, configured to dispense a total of between 0.5 and 5 ml, in particular between 1 and 3 ml, for example in 4 to 8 steps. It is moreover configured to be used only once and subsequently to be disposed of.

It is further suggested that the dispensing apparatus has a housing at which the at least one energy storage element is supported which storage element is configured as a spring. Thereby the at least one energy storage element can be configured simply from a construction point of view. In this connection a single spring can generally be provided for the at least two pistons as a common energy storage element.

However, it is also plausible to provide a like number of energy storage elements as the dispensing apparatus has pistons. In particular, for a design as springs, an arrangement of the energy storage elements within the pistons is thereby plausible, whereby the dispensing apparatus can be of particularly compact design. The following used terms "inwardly directed" and "outwardly directed" should, in particular be understood as an orientation with respect to the housing. The housing preferably has a substantially cylindrical shape, wherein "inwardly directed" preferably corresponds to a radially inwardly directed orientation with respect to the shape of the housing. In an analog manner "outwardly directed" preferably corresponds to an outwardly directed orientation with respect to the shape of the housing.

It is further advantageous when the track element is fixedly connected to the at least two pistons at least with respect to a movement along the direction of extent of the pistons. Thereby, the pistons can be coupled to one another very simply from a movement point of view. Furthermore, the two pistons are thereby fixed against the force of the at least one energy storage element via the common track element, whereby merely one track element must be provided. Moreover, the track element and the piston can thereby be of one piece design, for example, as a plastic injection molded part. Through such a design a constructively simple design is thus possible.

In a particularly advantageous embodiment it is suggested that the track element has a latched connection which defines a feed for the at least two pistons for the dispensing of the components. Thereby a path can be determined by which the pistons can be displaced on each actuation of the release element, whereby a simple, portioned dispensing of the multicomponent mass can be achieved. Through the portioned dispensing by means of the at least one energy storage element, for example, a handling can be improved.

Preferably, the latching element is fixedly connected to the housing. Thereby the feed unit can be of particularly simple design. Moreover, it can simply be achieved that the force acting on the piston, which is supplied by the at least one energy storage element, can again be supported at the housing, whereby the piston can advantageously be secured against a movement.

It is further suggested that the feed unit has a further latching element which is fixedly connected to the release element. Thereby a simple further latching of the track element can be supplied, which in alternation with the latching element, which is fixedly connected to the housing, is provided to displace the pistons for each actuation of the release element by a defined amount.

Preferably, the release element is provided to release a latched connection between the track element and the first latching element. Thereby the feed unit can be of particularly simple design, in particular when the further latching element is provided for a latched connection after the release of the latched connection between the track element and the first latching element. Thereby, the latching elements can alternatingly be brought into engagement with the track element on each actuation of the release element, whereby the feed unit permits a particularly simple actuation. The release element can, in particular be provided for an actuation by pressing in, whereby the dispensing apparatus can be handled particularly simply.

It is moreover advantageous when the dispensing apparatus has a mixing unit which is provided to mix the at least two components with one another during the dispensing. Thereby, an advantageous mixing of the components can be achieved. Preferably, the mixing unit and the housing are configured so as to be separate from one another, whereby the mixing unit has a design adapted to the multicomponent mass. In dependence on the multicomponent mass, the housing, which includes the feed unit, can then simply be connected to an adapted mixing unit.

BRIEF DESCRIPTION OF DRAWINGS

Further advantages result from the following description of the Figures. An embodiment of the invention is illustrated in the Figures. The Figures, the description of the Figures and the claims include numerous features in combination. A person of ordinary skill in the art will expediently also consider these features individually and combine these to form reasonable further combinations. In this connection there is shown:

DETAILED DESCRIPTION OF EMBODIMENTS

Figure 1:
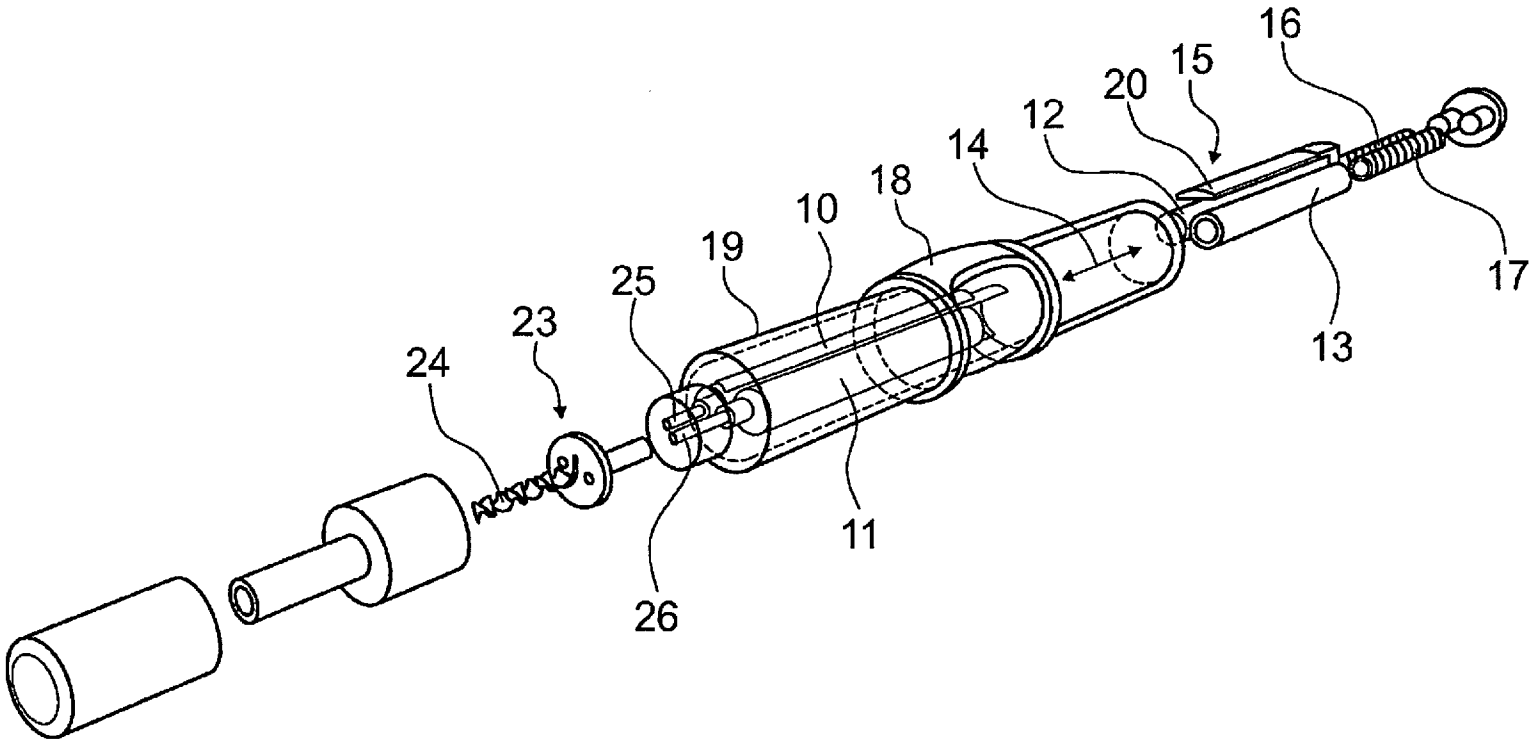
FIG. 1 is a dispensing apparatus in accordance with the invention in an exploded view.
Figure 2:
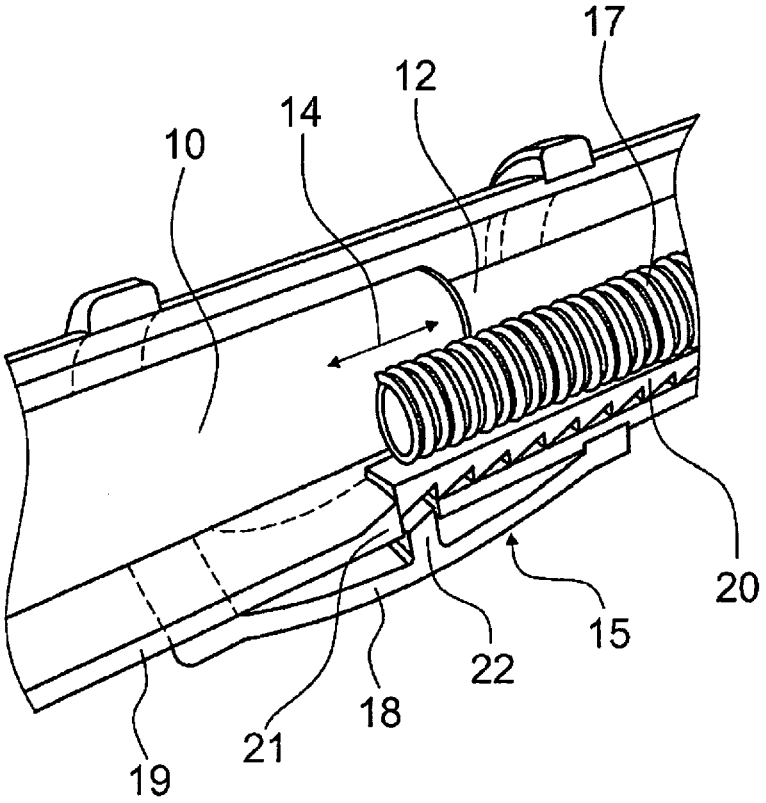
FIG. 2 is a feed unit of the dispensing apparatus.
Figure 3:
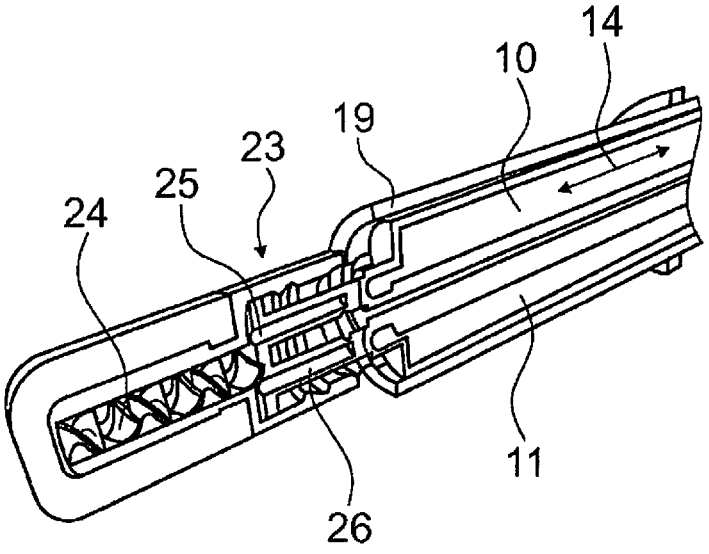
FIG. 3 is a mixing unit of the dispensing apparatus.

The FIGS. 1 to 3 show a dispensing apparatus for a multicomponent mass. The dispensing apparatus serves for the simultaneous dispensing of two different flowable components of the multicomponent mass from different storage volumes 10, 11 which are integrated in the dispensing apparatus. For the dispensing, the dispensing apparatus includes a mixing unit 23, by which the individual components are mixed with one another during the dispensing. The mixing unit 23 includes a static mixer element 24 which mixes the components with one another solely by a movement of the components through the mixing unit 23.

In the illustrated embodiment the dispensing apparatus is provided for a one-time use. The dispensing apparatus includes a housing 19 and two storage containers arranged within the housing 19 which span the storage volumes 10, 11 for the reception of the components. The storage volumes 10, 11 are separated from one another. In a state of delivery one of the components is introduced into each of the storage volumes 10, 11. The storage containers which form the storage volumes 10, 11 are fixedly connected to the housing 19. Since in the illustrated embodiment the dispensing apparatus is provided for a one-time use, the storage containers are not provided for an exchange. In this connection, the storage containers can generally be configured by the housing 19.

Principally, the dispensing apparatus can be provided for a multicomponent mass which has more than two components. In such a configuration, which is not illustrated in detail in the Figures, the dispensing apparatus includes more than the two storage volumes 10, 11. Furthermore, the dispensing apparatus can also be provided for a multi-time use, for example, in that the storage containers are configured separate from the housing 19 and are provided to be exchanged after a complete emptying.

The mixing unit 23 having the mixer element 24 is connected to the housing 19. The mixing unit 23 has an own inlet 25, 26 for each of the storage volumes 10, 11 through which inlet the corresponding components can flow through to the mixer element 24. In a state of delivery, the storage volumes 10, 11 are closed. A part of the mixing unit 23 which includes the mixer element 24 and the inlets 25, 26 is displaced against a dispensing direction in the direction of the housing 19 for opening the storage volumes 10, 11, and in this way for activating the dispensing apparatus. The inlets 25, 26 have lateral openings which immerse into the storage volumes 10, 11 on displacement and in this way open the storage volumes 10, 11 (cf. FIG. 3).

In order to dispense the components from the storage volumes 10, 11, the dispensing apparatus includes two pistons 12, 13 which are movably guided within the storage volumes 10, 11. The pistons 12, 13 are fixedly connected to one another, whereby they can simultaneously be moved with respect to one another. The pistons 12, 13 are arranged parallel with respect to one another. In the illustrated embodiment the storage volumes 10, 11 and the pistons 12, 13 are respectively of equal size, whereby the components have a mixing ratio of 1:1 in the dispensed state. Generally, the storage volumes 10, 11 can also have different cross-sectional areas, whereby the mixing ratio can then be defined. Independent of a ratio of the cross-sectional surfaces of the storage volumes 10, 11, the pistons 12, 13 are moved parallel to one another by the feed unit 15, this means simultaneously and with the same feed rate.

For the supply of a force for the movement of the pistons 12, 13 along the direction of extent 14 of the pistons 12, 13, the feed unit 15 has two energy storage elements 16, 17. The energy storage elements 16, 17 are each configured in the shape of a coil spring in the illustrated embodiment which springs are arranged within the associated piston 12, 13. In a state of delivery, the energy storage elements 16, 17 are biased and fixed by the feed unit 15.

The feed unit 15 further includes a release element 18, by which the movement of the pistons 12, 13 by the energy storage elements 16, 17 can be released. The energy storage elements 16, 17 are effectively arranged respectively between one of the pistons 12, 13 and the housing 19. One end of the energy storage elements 16, 17, configured as springs, is supported at the housing 19 and the other end is supported at the respective piston 12, 13.

For fixing the pistons 12, 13 against the force of the energy storage element 16, 17, the feed unit 15 includes a track element 20 and two latching elements 21, 22. The release element 18 partly forms a pressure button which can be actuated by a user for the release of the pistons 12, 13. An actuation direction of the release element 18 is oriented substantially perpendicular to the direction of extent 14 of the pistons 12, 13.

The housing 19 has a cylindrical shape. The release element 18 is arranged at the outside of the housing 19. The release element 18 has two rings for fastening, which rings grip around the housing 19. The rings are arranged spaced apart from one another along the direction of extent 14 of the pistons 12, 13. The pressure button is configured by a region of the release element 18*a* which is spatially arranged between the two rings. The pressure button configured by the release element 18 is outwardly directed and arranged at a side of the housing 19.

The track element 20 is fixedly connected to the two pistons 12, 13 with respect to a movement along the direction of extent 14 of the pistons 12, 13. The track element 20 is elastically deformable perpendicular to the direction extent 14 of the pistons 12, 13. The track element 20 forms a latched connection which is configured in the form of toothing. The track element 20 is arranged within the housing 19. The latched connection formed by the track element 20 is outwardly directed. The track element 20 and the latching elements 21, 22 are provided to latch the pistons 12, 13 and in this way to fix the energy storage elements 16, 17 against a force which permanently acts on the pistons 12, 13.

The latched connection of the track element 20 defines a feed rate by which the pistons 12, 13 are respectively moved on an actuation of the release element 18. The track element 20 has a plurality of teeth which form the latched connection. The feed rate is defined by a distance which the teeth respectively have with regard to one another. On each actuation of the release element 18 the track element 20 and the pistons 12, 13 coupled to the track element from a movement point of view are displaced further by a tooth. The pistons 12, 13 can be fixed in a plurality of intermediate positions by means of the track element 20. A number of the intermediate positions corresponds to a number of the teeth which the latched connection has.

The first latching element 21 is fixedly connected to the housing 19. It is inwardly directed and in this way faces the track element 20. If the release element 18 is unactuated, the latching element 21, fixedly connected to the housing 19, engages at the toothing of the latched connection of the track element 20. The latching element 21 latches the pistons 12, 13 against the force of the energy storage elements 16, 17 when the release element 18 is unactuated. The first latching element 21 is configured as one piece with the housing 19.

The second latching element 22 is fixedly connected to the release element 18. It is equivalent to the first latching element 21, likewise inwardly directed and provided for an engagement with the latched connection of the track element 20. When the first latching element 21 is in engagement with the latched connection the second latching element 22 is arranged between two teeth of the latched connection. A spacing, which both the latching elements 21, 22 have with respect to one another, deviates by multiple spacings between two teeth.

Through an actuation of the release element 18, the latching element 22 can be moved in a direction perpendicular to the direction of extent 14 of the pistons 12, 13. On an actuation of the release element 18 the latching element 22 is deflected inwardly. The release element 18 can be moved perpendicular to the direction of extent 14 by a path which is larger than a depth of the latched connection, whereby the track element 20 is pressed inwardly on an actuation of the release element 18.

Through the movement of the release element 18, the track element 20 having the latched connection is deflected, whereby the latched connection between the first latching element 21 and the track element 20 is released. The release element 18 is in this way provided to release the latched connection between the first latching element 21 and the track element 20. At the same time during the release, this means before the latched connection between the first latching element 21 and the track element 20 is completely released the second latching element 22 is moved into the latched connection.

The second latching element 22 is provided for a latched connection after the release of the latched connection between a track element 20 and a first latching element 21. After the release of the latched connection between the first latching element 21 and the track element 20 the pistons 12, 13 are moved by the force of the energy storage elements 16, 17, until the second latching element 22 abuts at a tooth of the latched connection of the track element 20. A path, by which the pistons 12, 13 are moved on the actuation of the release element 18, is smaller than the spacing which the teeth have.

If the release element 18 is again released, the latching element 22 connected to the release element 18 is moved out of the latched connection. The pistons 12, 13 are thereby again released for a movement, whereby the energy storage elements 16, 17 move the pistons 12, 13 further until the first latching element 21 lies at the next tooth of the latched connection. The pistons 12, 13 in this manner can be moved by the actuation of the release element 18 and the subsequent release of the release element 18 by a path defined by the latched connection, with the force supplied for the movement of the pistons 12, 13 merely being supplied by the energy storage elements 16, 17.

The dispensing apparatus is substantially manufactured from plastic. In particular the housing 19 having the first latching element 21, the release element 18 having the second latching element 22, as well as the pistons 12, 13 and the track element 20 are made of plastic in an injection molding process. The two pistons 12, 13 and the track element 20 are in this connection preferably of one piece design. The mixing unit 23 is typically configured separate from the housing 19, wherein the housing 19 can be connected to mixing units 23 of different design.

The invention claimed is:

1. A dispensing apparatus for the simultaneous dispensing of at least two flowable components of a multicomponent mass from different storage volumes, comprising:

at least two pistons configured to be displaced along a direction of piston extent so as to dispense components from at least two storage volumes; and a feed unit configured to move the pistons along the direction of piston extent, the feed unit having a least one energy storage element configured to supply a force for movement of the pistons and having at least one release element configured to release the movement of the pistons by the at least one energy storage element, the feed unit including a track element configured to move in a direction transverse to the direction of piston extent and at least one latching element configured to latch the at least two pistons with respect to the force of the energy storage element.

2. The dispensing apparatus in accordance with claim 1, further comprising a housing at which the at least one energy storage element is supported, the at least one energy storage element being a spring.

3. The dispensing apparatus in accordance with claim 1, wherein the track element is fixedly connected to the at least two pistons at least with respect to a movement along the direction of piston extent.

4. The dispensing apparatus in accordance with claim 1, wherein the track element has a latched connection defining a feed for the at least two pistons.

5. The dispensing apparatus in accordance with claim 2, wherein the latching element is fixedly connected to the housing.

6. The dispensing apparatus in accordance with claim 1, further comprising a mixing unit configured to mix the at least two components with one another during dispensing.

7. A dispensing apparatus for the simultaneous dispensing of at least two flowable components of a multicomponent mass from different storage volumes, comprising:

at least two pistons configured to be displaced along a direction of piston extent so as to dispense components from at least two storage volumes; and a feed unit configured to move the pistons along the direction of piston extent, the feed unit having a least one energy storage element configured to supply a force for movement of the pistons and having at least one release element configured to release the movement of the pistons by the at least one energy storage element, the feed unit including a track element, a first latching element configured to latch the at least two pistons with respect to the force of the energy storage element, and a further latching element fixedly connected to the release element.

8. The dispensing apparatus in accordance with claim 7, wherein the release element is configured to release a latched connection between the track element and the first latching element.

9. The dispensing apparatus in accordance with claim 8, wherein the further latching element is configured to provide a latched connection after the release of the latched connection between the track element and the first latching element.

* * * * *